US010900660B2

(12) United States Patent
Narin et al.

(10) Patent No.: US 10,900,660 B2
(45) Date of Patent: Jan. 26, 2021

(54) FLUIDIZED BED HEAT EXCHANGER

(71) Applicant: DOOSAN LENTJES GmbH, Ratingen (DE)

(72) Inventors: Oguzhan Narin, Sprockhovel (DE); Damian Goral, Sosnowiec (PL)

(73) Assignee: DOOSAN LENTJES GmbH, Ratingen (DE)

( * ) Notice: Subject to any disclaimer, the term of this patent is extended or adjusted under 35 U.S.C. 154(b) by 850 days.

(21) Appl. No.: 15/039,072

(22) PCT Filed: Oct. 9, 2014

(86) PCT No.: PCT/EP2014/071693

§ 371 (c)(1),
(2) Date: May 25, 2016

(87) PCT Pub. No.: WO2015/090665

PCT Pub. Date: Jun. 25, 2015

(65) Prior Publication Data

US 2017/0016616 A1 Jan. 19, 2017

(30) Foreign Application Priority Data

Dec. 16, 2013 (EP) ..... 13197376

(51) Int. Cl.
*F23C 10/04* (2006.01)
*F23C 10/00* (2006.01)
(Continued)

(52) U.S. Cl.
CPC ..... *F23C 10/04* (2013.01); *F01K 5/02* (2013.01); *F23C 10/00* (2013.01); *F28D 7/087* (2013.01);
(Continued)

(58) Field of Classification Search
CPC .... F23C 10/04; F23C 10/00; F23C 2206/103; F01K 5/02; F28D 7/087; F28D 13/00; F28F 9/026; F28F 9/22; F28F 2009/226
(Continued)

(56) References Cited

U.S. PATENT DOCUMENTS 4,469,050 A * 9/1984 Korenberg ..... B01J 8/26 110/245
4,674,560 A * 6/1987 Marcellin ..... B01J 8/1809 165/104.16
(Continued)

FOREIGN PATENT DOCUMENTS

| | | |
|---|---|---|
| EP | 0332360 A1 | 9/1989 |
| EP | 0495296 A2 | 7/1992 |
| WO | 97/06889 A1 | 2/1997 |

OTHER PUBLICATIONS

International Search Report for PCT/EP2014/071693 dated Jan. 23, 2015.

*Primary Examiner* — Tho V Duong
*Assistant Examiner* — Raheena R Malik
(74) *Attorney, Agent, or Firm* — Ralph E. Jocke; Colin P. Cochran; Walker & Jocke

(57) ABSTRACT

A fluidized bed heat exchanger with a chamber (24) comprises a solid particles inlet port (22), a solid particles outlet port (30), arranged at a distance to the inlet port (22), means (46) for introducing a fluidizing gas from a bottom area into the chamber (24). The heat exchanger further comprises at least two heat transfer means (28) within the one chamber (24), each being provided with a heat transfer medium inlet port (42) and a heat transfer medium outlet port (44), wherein a first heat transfer means (28) is designed as a reheater and second heat transfer means (28) is designed as a superheater to achieve a heat transfer medium temperature and a heat transfer medium pressure above that of the
(Continued)

Figure 1:
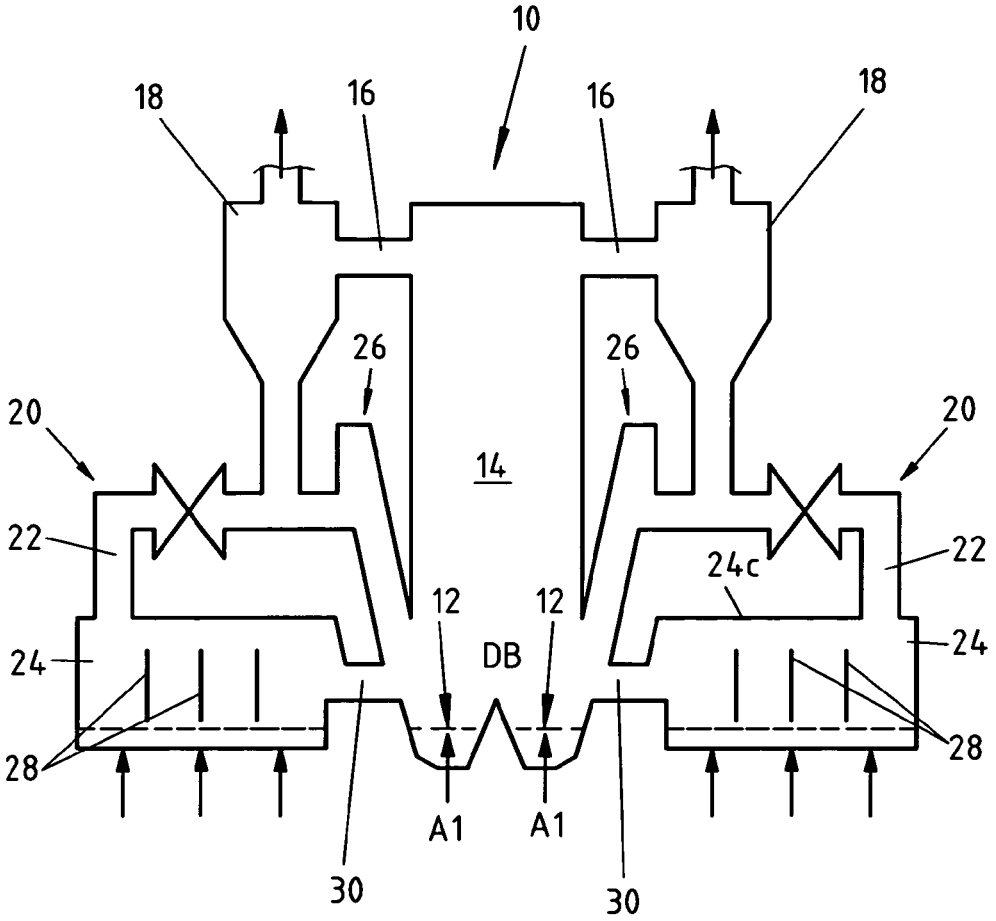

reheater. At least one of the reheater or superheater is made of a multiplicity of heat transfer tubes arranged in a meandering fashion for conveying a heat transfer medium.

26 Claims, 10 Drawing Sheets

(51) Int. Cl.

| | |
|---|---|
| ***F28F 9/02*** | (2006.01) |
| ***F28D 13/00*** | (2006.01) |
| ***F28F 9/22*** | (2006.01) |
| ***F28D 7/08*** | (2006.01) |
| ***F01K 5/02*** | (2006.01) |

(52) U.S. Cl.
CPC ..... *F28D 13/00* (2013.01); *F28F 9/026* (2013.01); *F28F 9/22* (2013.01); *F23C 2206/103* (2013.01); *F28F 2009/226* (2013.01)

(58) Field of Classification Search
USPC ..... 165/104.16
See application file for complete search history.

(56) References Cited

U.S. PATENT DOCUMENTS 4,716,856 A * 1/1988 Beisswenger ..... B01J 8/0055 110/245
4,869,207 A * 9/1989 Engstrom ..... B01J 8/006 122/4 D
5,014,652 A * 5/1991 Hyldgaard ..... F22B 31/0084 122/4 D
5,040,492 A * 8/1991 Dietz ..... F22B 31/0084 110/245
5,269,263 A * 12/1993 Garcia-Mallol ..... F23C 10/10 110/245
5,316,736 A * 5/1994 Vidal ..... B01J 8/28 110/245
5,365,889 A * 11/1994 Tang ..... F23G 5/027 110/245
5,634,516 A * 6/1997 Myohanen ..... B01J 8/386 122/4 D
5,772,969 A * 6/1998 Hyppanen ..... B01J 8/1836 422/139
7,562,641 B2 * 7/2009 Murakami ..... F23C 10/10 122/4 D
8,069,824 B2 * 12/2011 Higgins ..... F23C 10/10 122/4 D

* cited by examiner

FLUIDIZED BED HEAT EXCHANGER

The invention relates to so-called Circulating Fluidized Bed Apparatus (CFBA) and its components, in particular

- a Circulating Fluidized Bed Reactor (CFBR) designed as a combustor, incineration reactor, boiler, gasifier, steam generator etc. as disclosed—i.a.—in U.S. Pat. No. 6,802,890 B2. In a typical CFBR gas (air) is passed through a permeable grate-like bottom area of the reactor, which grate (grid) supports a fluidized bed of particulate material, the so-called incineration charge, mostly including a fuel-like material such as coal. This gives the fuel material and other components within the fluidized bed the behaviour of a boiling liquid.
- The aerated particulate material/fuel mixture allows to promote the incineration process and effectivity.
- The incineration charge is fluidized by the air/gas, often blown in via nozzles. The fluidized bed comprises a so-called denseboard area, above said grate and adjacent to the said permeable reactor bottom, while the density of the particulate material within the fluidized bed gets less within the upper part of the reactor space, also called the freeboard area of the fluidized bed.
- The reaction chamber is often limited by outer water tube walls, made of tubes, through which water runs, wherein said tubes are either welded directly to each other to give a wall structure or with fins/ribs between parallel running tube sections.
- As most of said fuel materials like coal, timber etc. contain sulphur and/or harmful substances it is necessary to clean the gases leaving the reaction chamber, in a suitable way.
- The CFBR typically has at least one outlet port at its upper end, wherein said outlet port allows the mixture of gas and solid particles exhausted from the reactor, to flow into at least one associated separator.
- The separator, for example a cyclone separator, serves to separate solid particles (the particulate material, including ash) from said gas. A typical design of such a separator is disclosed in U.S. Pat. No. 4,615,715. Again the outer walls of the separator can be designed with hollow spaces to allow water flowing through.
- Means for the transfer of said separated solid particles into at least one Fluidized Bed Heat Exchanger (FBHE) via a corresponding inlet port of said FBHE. These means may be ducts/pipes/channels or the like.
- A syphon along the way from the separator to the CFBR and/or FBHE to allow decoupling of pressure (fields) between separator and CFBR.
- At least one Fluidized Bed Heat Exchanger (FBHE) allowing to use the heat, provided by the particulate material, for generating power, for example to heat up and increase the pressure of a steam transported as a heat transfer medium via tubes or the like, through said FBHE and further to turbines or the like.
- The FBHE is equipped with at least one outlet port, also called return means, for at least part of the solid particles on their way out of the FBHE and back into the Circulating Fluidized Bed Reactor CFBR.

Numerous designs of such apparatus and components have been developed over the past decades.

Nevertheless there is a continuous demand for improvements, especially with respect to energy efficiency (typical capacity range: 50-600 MW—electrical—), effectiveness, simple construction, avoidance of mechanical and thermo-mechanical stresses, compactness (typical data of a reactor chamber are: height: 30-60 m, width: 13-40 m, depth: 15-40 m).

The invention provides the following improvements with respect to a Circulating Fluidized Bed Apparatus, hereinafter also called CFBA, fluidized bed apparatus or apparatus and its components, which may be realized individually or in arbitrary combinations as far those combinations are not explicitly excluded hereinafter or excluded by technical reasons. Accordingly individual construction features may be realized individually and/or in arbitrary combinations. Different embodiments may be realized within one apparatus if proper.

Accordingly features, disclosed in connection with one of the following improvements may also be realized in connection with another improvement.

Improvement A refers to a

Fluidized bed apparatus, comprising a circulating fluidized bed reactor with at least one outlet port at its upper part, wherein said outlet port allows a mixture of gas and solid particles exhausted from the circulating fluidized bed reactor to flow into at least one associated separator for separating solid particles from said gas, means to transfer said separated solid particles into at least one fluidized bed heat exchanger and return means to transport at least part of the solid particles back into the circulating fluidized bed reactor, wherein the circulating fluidized bed reactor, the separator and the fluidized bed heat exchanger are mounted in a suspended manner.

The totally suspended (for example hanging) construction allows to adapt the thermal expansions of the associated construction elements and avoids mechanical forces, thermo-mechanical forces and/or moments between adjacent construction parts.

Different thermal loads within the CFBR and an associated FBHR typically lead to different thermal expansions of both construction elements (parts of the apparatus). Accordingly return means (for the solid particles), for example a solid return duct, extending from the FBHR to the CFBR, typically undergoes considerable thermo-mechanical stresses, which now can be avoided.

This is contrary to prior art devices with a suspended reactor, a heat exchanger mounted to ground and a return duct in between.

Optional features are:

- The circulating fluidized bed reactor, the separator and the fluidized bed heat exchanger are suspended from a supporting structure, which may be a common supporting structure, for example a tripod like or a gateway-like structure, a frame etc. The suspended mounting may be realized directly or indirectly.
- The fluidized bed heat exchanger is suspended from the separator. This is an example for an indirect suspension/hanging. The separator may be suspended from a traverse/bar, while the FBHE is suspended from the separator.
- The fluidized bed heat exchanger is fixedly secured to the circulating fluidized bed reactor. Again this is an indirect type of suspension. The FBHE is coupled to the CFBR, which itself may be hung to a corresponding frame.
- The fluidized bed heat exchanger and the fluidized bed reactor have a common wall. This gives a compact design and saves one wall.
- The common wall is water-cooled.
- The common wall has one or more openings fulfilling the function of the return means or the function of an outlet port for the solid particles respectively. A separate outlet port (for example a duct) may be avoided.

The return means are designed as a coupling without transferring mechanical forces or moments from said fluidized bed reactor into said fluidized bed heat exchanger or vice versa. This embodiment in-situ provides a suspended connection between the two construction parts and avoids any mechanical stresses.

The fluidized bed heat exchanger has no refractory lining. This makes is lighter and thus easier to hang.

The fluidized bed heat exchanger has chamber walls being at least partially water-cooled.

No structural means within the FBHE, which tend to urge the solid particles to meander within the fluidized bed heat exchanger. Contrary to common designs the FBHE does not provide any separate entrance chamber and/or return chamber through which the solid particles must pass after entering the FBHE and/or before leaving it. No pre-homogenization of the solid particles being necessary any more. The solid particle stream enters the FBHE and is immediately directed through/along the heat exchangers.

Improvement B refers to a:

Fluidized bed apparatus, comprising a circulating fluidized bed reactor with at least one outlet port at its upper part, wherein said outlet port allows a mixture of gas and solid particles exhausted from the fluidized bed reactor to flow into a number (n) of associated separators for separating solid particles from said gas, a number (n) of means to transfer said separated solid particles from said (n) separators into a number (up to n) of discrete fluidized bed heat exchangers, and return means to transport at least part of said solid particles back from said discrete fluidized bed heat exchangers into the circulating fluidized bed reactor, wherein the number (up to n) of discrete fluidized bed heat exchangers are mechanically connected to provide one common fluidized bed heat exchanger with water cooled intermediate walls between adjacent discrete fluidized bed heat exchangers.

Typically each separator is followed by one heat exchanger (with a syphon like seal in between), while the improvement reduces the number of construction parts insofar as at least two, or three, or all (namely n) heat exchangers are combined into one element. This make the apparatus more compact and more effective. Cooling means (water cooled walls) can be designed as common walls between adjacent sections of a combined heat exchanger.

Optional features are:

The discrete fluidized bed heat exchangers are arranged in a row (a line) to provide the common fluidized bed heat exchanger, which allows a very compact design.

The water cooled intermediate walls comprise water-cooled pipes, in particular metal pipes.

The water cooled intermediate walls comprise water-cooled pipes, wherein adjacent pipes are connected by metal fins. Fins and pipes can be welded.

The common fluidized bed heat exchanger is suspended from the separator(s). This hanging construction reduces the installation costs and required space.

The common fluidized bed heat exchanger is fixedly secured to the circulating fluidized bed reactor, allowing a compact overall design.

The common fluidized bed heat exchanger and the circulating fluidized bed reactor have a common wall. Again this makes the installation compact.

The common wall is water-cooled.

The common wall has one or more openings fulfilling the function of the return means (outlet port). Space for a separate return duct or the like can thus be avoided The fluidized bed heat exchanger has outer chamber walls being at least partially water-cooled.

The FBHE is designed without any structural means urging the solid particles to meander within the fluidized bed heat exchanger. Contrary to common designs the FBHE does not provide any separate entrance chamber and/or return chamber through which the solid particles must pass after entering the FBHE and/or before leaving it. No pre-homogenization of the solid particles being necessary any more.

Improvement C refers to a:

Fluidized bed heat exchanger (FBHE) with a chamber, comprising at least one solid particles inlet port, at least one solid particles outlet port, arranged at a distance to the at least one inlet port, means for introducing a fluidizing gas from a bottom area of said chamber into said chamber, at least one heat transfer means arranged within said chamber, wherein the heat transfer means is designed in a wall-like pattern and extending substantially parallel to the main flow direction of the solid particles on their way to and through the outlet port.

The wall like structure (a flat and compact design of an individual heat transfer means) in combination with its orientation are the main features, allowing to arrange a group (set) of multiple heat transfer means at a distance to each other with channels like "cavities/gaps" in between, extending as well in the flow/transport direction of the solid particles towards the outlet area of the chamber.

Insofar the term "wall like" does not refer to a cubic design with flat surfaces but the overall volume which the respective heat transfer means take. A tube, meandering (zig-zag) such that the central longitunal axis of the tube lies in one imaginary plane is an example for a wall-like pattern. Tube sections may extend in different directions along two axis of the coordinate system.

This design allows the solid particles within the fluidized bed to flow between said individual heat transfer means, namely within said spaces (channels) formed between adjacent heat transfer means, without any obstacles (baffles) but including the option to flow from one of said channels/spaces/gaps into an adjacent one.

This is true especially if the discrete heat transfer means are provided be bended tubes/pipes, for example according to one of the following optional features:

The wall like pattern comprises a grid-like structure. This allows the solid particles to flow in all directions of the coordinate system but keeps the barrier free main transport direction towards the outlet port.

The heat transfer means is designed as a heat exchange tube for conveying a heat transfer medium and arranged in a meandering fashion, thereby providing a vertically oriented wall-like pattern.

Multiple heat transfer means are arranged at a distance to each other, forming a set/group of heat transfer means. This gives a package/set of heat transfer means, extending over more than 50% of the chamber volume.

Heat transfer means extend about more than 60% of the chamber height.

Heat transfer means extend about more than 70% of the chamber height.

Heat transfer means extend from shortly above the bottom upwardly to shortly below the ceiling of said chamber. The larger the heat transfer means are the more efficient is the total heat exchange.

Horizontally extending sections of the meandering heat exchange tube are at least 3 times longer than vertically extending sections of the heat exchange tube. This underlies the main transport direction of the solid particles.

Adjacent sections of the same heat exchange tube extend at a distance to each other being 0.5 to 2 of the heat exchange tube diameter.

Chamber walls being at least partially water-cooled.

No structural means urging the solid particles to meander within the chamber. They may pass the FBHE in a main direction parallel to the wall-like heat exchangers.

No entrance chamber and/or return chamber for the solid particles being provided in the FBHE to allow a continuous flow pattern.

The FBHE may have a common wall with an adjacent circulating fluidized bed reactor (CFBR) and return means for the solid particles may extend at least partially within said common wall to make the installation more compact.

The common wall is a water-cooled wall.

Improvement D refers to a:

Fluidized bed heat exchanger with one chamber, comprising at least one solid particles inlet port, at least one solid particles outlet port, arranged at a distance to the at least one inlet port, means for introducing a fluidizing gas from a bottom area of said chamber into said chamber, at least two heat transfer means within said one chamber, each being provided with a heat transfer medium inlet port and a heat transfer medium outlet port, wherein a first heat transfer means is designed as a reheater and second heat transfer means is designed as a superheater to achieve a heat transfer medium pressure above that of the reheater.

This design is best realized with at least two distinct groups/sets of heat transfer means to provide different thermodynamic features within the FBHE and to allow to optimize the heat transfer and efficiency of the FBHE.

All heat transfer means (for example distinct steam tubes) of one group may be linked to one central steam feeding line and steam outlet line respectively. Insofar the extra work for installation is reduced to one further feeding and extracting line, in case of two groups of heat exchangers, while allowing to achieve different thermodynamic conditions within the chamber.

This can be complete by one or more of the following features:

The reheater is constructed to allow a heat transfer medium temperature of up to 600° C. (while the inlet temperature of the heat transfer medium, for example steam, is typically about 450-550° C.).

The reheater is constructed to allow a heat transfer medium pressure of up to 50 bar (typically in the range of 30-40 bar).

The superheater is constructed to allow a heat transfer medium temperature of up to 600° C. (typically with inlet temperatures between 500 and 580° C.).

The superheater is constructed to allow a heat transfer medium pressure of up to 190 bar (typically between 160 and 180 bar).

The fluid pressure in the superheater tubes is typically more than 3, or more than 4 or even more than 5 times the pressure in the reheater tubes.

The reheater and/or the superheater each are made of a multiplicity of heat transfer tubes, each arranged in a meandering fashion and with a distance to each other. Accordingly the reheater and the superheater each have a 3-dimensional profile similar to a cube. Each tube may provide a wall-like (plate-like) structure with a grate-like pattern according to the meandering tube sections. The solid particles pass through channels between the heat transfer means.

The chamber walls can be at least partially water-cooled.

Again this FBHE and an associated circulation fluidized bed reactor CFBR may have a common wall to reduce costs and make the apparatus compact.

This common wall can be water-cooled.

Improvement E refers to a:

Fluidized bed apparatus, comprising a circulating fluidized bed reactor of a vertical axial length L in its functional position, with at least one outlet port at its upper part, wherein said outlet port allows a mixture of gas and solid particles exhausted from the fluidized bed reactor to flow into at least one associated separator for separating solid particles from said gas, means to transfer said separated solid particles into at least one fluidized bed heat exchanger and return means to transport at least part of said the solid particles back into the fluidized bed reactor, wherein the return means are designed such that their lowermost point enters into the fluidized bed reactor at a minimum height of 0.1 L, calculated from the lowermost end of said axial length (L) of the fluidized bed reactor in its functional position.

In other words: This design gives an optimized return position for the solid particles back into the CFBR.

The minimum distance between the bottom area of the CFBR and the place, where the solid particles enter the CFBR, guarantees that the solid particles may freely enter the combustion chamber (the fluidized bed) and avoids any backflow from the fluidized bed, especially from the dense-board (=high pressure zone) of the fluidized bed, being the lowermost section of the fluidized bed, right above the aerated/pressurized bottom. FBHE does not require any complex sealing systems along the return means/outlet port.

The length L of the CFBR is defined as the distance between the upper surface of the aerated bottom (grate-/nozzle area) and the inner surface of the chamber ceiling.

Optional features are:

The return means of FBHE are designed such that their lowermost point enters into the fluidized bed reactor at a minimum height of 0.15 L or 0.20 L, calculated from the lowermost end of said axial length (L) of the fluidized bed reactor.

The lowermost point of said return means of FBHE enters into the fluidized bed reactor at a distance to the uppermost point of a dense board of said fluidized bed reactor.

Said return means comprise multiple flow through openings for said solid particles; a row of flow through openings, arranged at a distance to each other, equalizes the flow of the solid particles (like ash) on their way back into the reactor.

The fluidized bed heat exchanger is fixedly secured to the fluidized bed reactor. A very simple construction with a precise return position for the solid particles.

This is in particular true if the fluidized bed heat exchanger and the fluidized bed reactor have a common wall.

The common wall has one or more openings fulfilling the function of the return means. This allows again a very compact structure.

The return means are designed as a coupling without transferring mechanical forces or moments from said fluidized bed reactor into said fluidized bed heat exchanger or vice versa.

The fluidized bed heat exchanger has a refractory lining.

The chamber walls of the FBHE are at least partially water-cooled.

Any further return means from the separator and/or a syphon enter the CFBR shortly above its grate, i.e. directly into the denseboard (dense part) of the circulating fluidized bed and below the FBHE return means.

Yet another improvement (F) relates to a:

Fluidized bed heat exchanger with a chamber, comprising at least one solid particles inlet port, at least one solid particles outlet port, arranged at a distance to the at least one inlet port, means for introducing a fluidizing gas from a bottom area of said chamber into said chamber, at least one heat transfer means, arranged within said chamber, wherein at least one distribution means being arranged in a transition region between said inlet port and said chamber and upstream of said heat transfer means to allow dilution of said solid particles.

This improvement relates to feeding of the particulate material into the fluidized bed heat exchanger (FBHE). The FBHE (its inner chamber/space) typically has a cubic or cylindrical shape of high volume.

If the solid particles, coming from the separator, enter said chamber along a discrete inlet port of limited size, problems may arise in distributing the said particulate material within the chamber and around/between the heat transfer means to achieve the required heat transfer.

The improvement allows to distribute the solid particles on their way into the chamber over a much larger area, depending on the shape and size of the distribution means. At the same time the density of the solids within the particle stream is reduced, which further increases the heat transfer efficiency from the hot particles into the heat transfer medium (a brine, steam or the like).

The term "transition region" includes the end section of the inlet port adjacent to the chamber of the FBHE as well the adjacent section of the chamber and any area in between.

Possible alternatives and embodiments include a fluidized bed heat exchanger with one or more of the following features:

The distribution means are provided by construction elements protruding from an inner surface of said inlet port and/or chamber. They may protrude from a wall or ceiling section.

The distribution means are provided by at least one of the following construction elements: bar, knob, prism, grid, grate, pyramid, spiral, saw tooth, dowel, nib, nozzle.

The distributions means extend >30,>40 or >50% of the length or width of the chamber to homogenize the stream of the fluidized bed within the chamber to its best.

The distributions means are arranged shortly downstream of the inlet port, i.e. along the upper part of the chamber.

The inlet port enters the chamber by its ceiling. This gives the solid particles a transport direction following gravity.

The inlet port enters the chamber through an upper end of a chamber wall ( ). Then the flow of the solid particles is substantially horizontal before entering the chamber.

Multiple heat transfer means which are arranged at a distance to each other, allow to give the solid particles a certain flow profile through the chamber (along intermediate channels).

The chamber walls may be at least partially water-cooled.

A fluidized bed heat exchanger without any structural means (except that distribution means at the entrance area and the heat transfer means) allows the solid particles to pass the chamber without further meandering.

Improvement G refers to a design with a common wall between the CFBR and FBHE, namely a Fluidized bed apparatus comprising a circulating fluidized bed reactor with at least one outlet port at its upper part, wherein said outlet port allows a mixture of gas and solid particles exhausted from the fluidized bed reactor to flow into at least one associated separator for separating solid particles from said gas, means to transfer said separated solid particles into at least one fluidized bed heat exchanger as well as return means to transport at least part of said solid particles back into the circulating fluidized bed reactor, wherein the said circulating fluidized bed reactor and said fluidized bed heat exchanger have at least one common wall and said return means are provided within said common wall.

This allows to use one wall (section) commonly for 2 independent components of the apparatus and thus to reduce the material and construction costs.

The integration of the return means allows further reductions in construction work, material costs and increases the efficiency. The material flow from the FBHE into the combustion reactor becomes more reliable and more homogeneous.

Optional feature to this improvement include:

The return means are provided by at least one through hole within said common wall, this is a very simple and effective design.

The return means are multiple through holes arranged at a distance to each other (for example in a horizontal row) within said common wall.

The at least one through hole is inclined, with a lower end towards the fluidized bed heat exchanger and a higher end towards the fluidized bed reactor. This reduces the danger of infiltration of particles from the fluidized bed of the CFBR into the FBHE.

The common wall provides a three-dimensional profile towards the fluidized bed heat exchanger. This allows to partly or fully integrate the sloping outlet port into the common wall area.

The common wall provides a convexity towards the fluidized bed heat exchanger. Again this allows to integrate the inclined outlet duct/openings into the shared wall and keeps the pressure on said outflowing material low.

A further improvement H relates to a:

Fluidized bed heat exchanger with a chamber, comprising at least one solid particles inlet port, at least one solid particles outlet port, arranged at a distance to the at least one inlet port, means for introducing a fluidizing gas from a bottom area of said chamber into said chamber, at least one heat transfer means, arranged within said chamber, wherein said means for introducing the fluidizing gas are provided by a multiplicity of nozzles arranged along the bottom area of said chamber and different nozzles being charged with different gas pressure.

In other words:

The aerated bottom (the air/gas permeable bottom as part of the fluidized bed) is divided into sections/zones/areas, where air is applied under different pressure. This allows to provide a custom-made pressure profile within the FBHE and thus to optimize the heat transfer and particle transport. A multiplicity of air openings, mostly provided by air nozzles, can be linked to a common air feeding duct or funnel.

Possible embodiments include:

- A multiplicity of nozzles is split into two or more nozzle sets; each nozzle set comprising a plurality of nozzles, wherein each nozzle sets may be charged with an individual gas pressure, for example with a different gas pressure.
- The nozzles of one nozzle set are arranged within one common area. This allows to split the overall bottom area into two, three or more larger sections.
- The gas pressure of a nozzle set is adjustable. This allows to adapt the gas pressure according to local demands.
- Each nozzle set is coupled to a corresponding gas channel or gas distribution space respectively in order to adjust the required pressure in the respective manner with respect to all nozzles of a nozzle set connected thereto.
- A fluidized bed heat exchanger without any structural means (except distribution means at the entrance area and the heat transfer means) allows the solid particles to pass the chamber without further meandering, to the contrary: their path through the FBHE is mostly influenced by the air pressure along the bottom grate.

A similar design may be used for a syphon arranged between separator and CFBR according to the following improvement I:

Fluidized bed syphon with a U-shaped chamber, comprising a vertically oriented solid particles entrance port, a vertically oriented solid particles exit port, arranged at a distance to the entrance port, and a horizontally oriented intermediate section in fluidic connection with said entrance port and said exit port, means for introducing a fluidizing gas from a bottom area of said chamber into said chamber, wherein said means for introducing the fluidizing gas are provided by a multiplicity of nozzles, arranged along the bottom area of said chamber and different nozzles being charged with different gas pressure.

The overall design of said syphon, serving as a gas seal between components of the fluidized bed apparatus connected upstream and downstream of said syphon, is similar to that of the fluidized bed heat exchanger as disclosed above. The main difference is, that the syphon does not necessarily comprise any heat transfer means.

To provide a bottom area of the syphon as a fluidized bed and the partition of said fluidized bed into discrete sections allows to adapt the air/gas volume and pressure individually for each of said sections.

One possible arrangement is: A first nozzle set blows air in a counterflow to the solid particles into the entrance port, a second nozzle set provides nozzles which blow air/gas into the mostly horizontally oriented stream of solid particles along the intermediate section while a third nozzle set blows air into the solid particles leaving the syphon via the exit port, wherein air/gas and solid particles have the same transport direction along this exit section.

Optional features for this type of syphon are:

- The multiplicity of nozzles is split into two or more nozzle sets, each nozzle set comprising a plurality of nozzles, wherein each nozzle set is charged with a different gas pressure.
- The nozzles of one nozzle set are arranged within one common area.
- The gas pressure of a nozzle set is adjustable.
- Each nozzle set is coupled to a corresponding gas channel or gas distribution space respectively.
- Chamber walls being at least partially water-cooled.
- The bottom area of the chamber extends along substantially the full width and length of the U-shaped chamber.
- A first nozzle set extends along the bottom area of the intermediate chamber section and discrete second and third nozzle sets along sections of said entrance port and exit port, which follow the bottom area of the intermediate section to both sides.

Improvement K relates to a:

Fluidized bed heat exchanger with a chamber, comprising at least one solid particles inlet port, at least one solid particles outlet port, arranged at a distance to the at least one inlet port, means for introducing a fluidizing gas from a bottom area of said chamber into said chamber, at least one heat transfer means, arranged within said chamber, at least one baffle which extends downwardly from a chamber ceiling, substantially perpendicular to a straight line between inlet port and outlet port, with its lower end at a distance to the heat transfer means.

This at least one baffle does not influence the flow of the solid particles within the part of the FBHE equipped with the heat transfer means as it is arranged above said heat transfer means and only serves to redirect the incoming solid particle stream (downwardly) and to equalize the pressure above the fluidized bed and along the horizontal cross section of the chamber, in particular, if provided with opening(s).

The baffles have the function of separation walls and avoid short circuits of the solid material flow (directly from the inlet port to the outlet port). They urge the solid particle stream to penetrate into the heat transfer zone between the heat transfer means (the channels mentioned above). The baffle construction may interact with improvement H.

The following embodiments are optionally included:

- At least one baffle extends between opposite walls of the chamber to improve the describe effect.
- At least one baffle has at least one opening to allow pressure adjusting/compensation within the chamber.
- At least one baffle is at least partially water-cooled.
- At least one baffle is designed as a curtain. The curtain defines a baffle with numerous small openings which allow pressure equalization but avoids penetration of the solid particles to great extent.
- Multiple baffles are arranged at a distance to each other along said line between inlet port and outlet port.
- The heat transfer means are designed as a heat exchange tube for conveying a heat transfer medium and arranged in a meandering fashion, thereby providing a vertically oriented wall-like pattern. The individual heat transfer walls extend perpendicular to the baffles.

The invention is now described with reference to the attached drawing, showing—all in a very schematic way—in

FIG. 1

A general concept of a fluidized bed apparatus according to prior art

FIG. 2

A cross sectional view of a fluidized bed heat exchanger

FIG. 3

Figure 2:
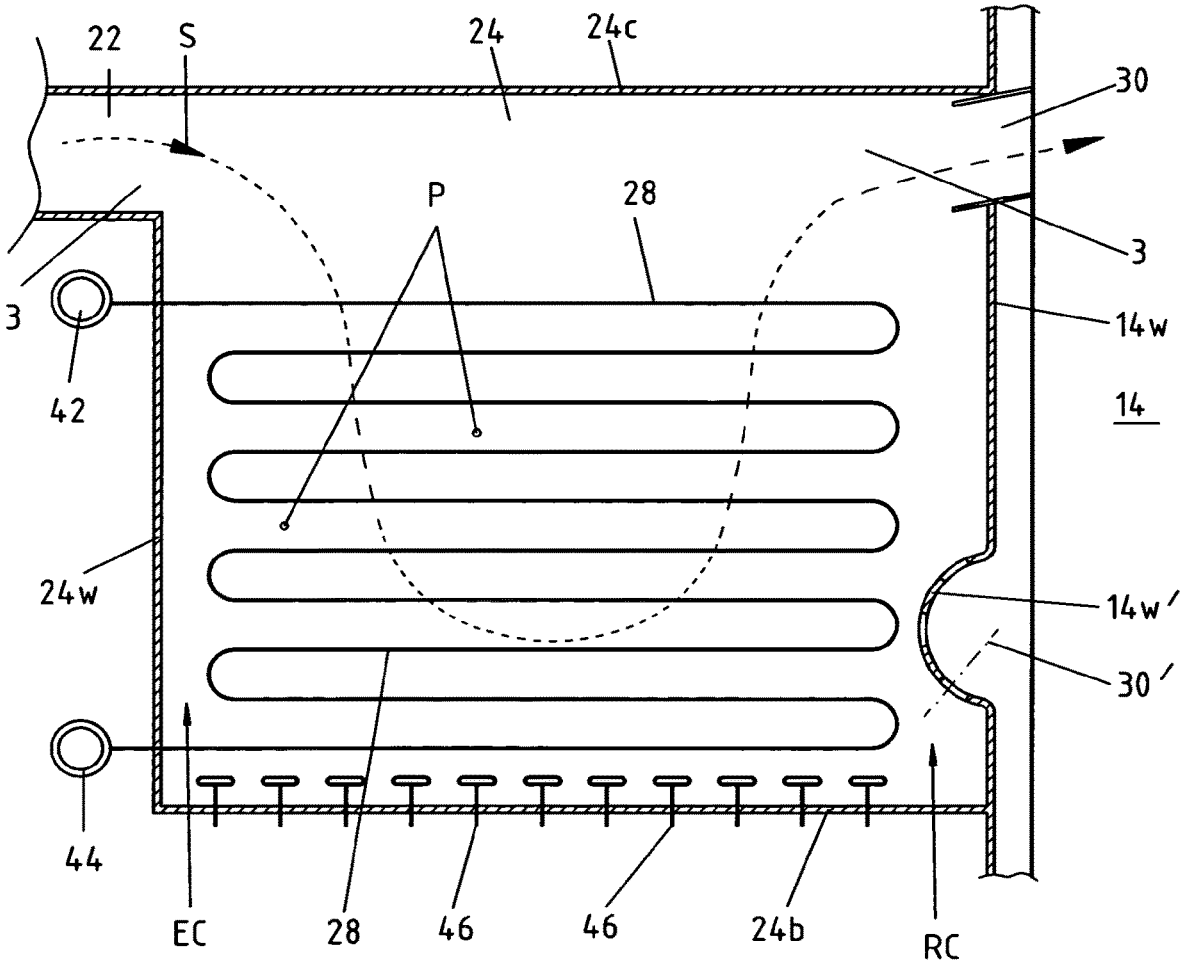

A top view on the FBHE 24 of FIG. 2 along line 3-3

FIG. 4

A cross sectional view of another embodiment of a fluidized bed heat exchanger

FIG. 5

A cross sectional view of further embodiment of a fluidized bed heat exchanger A with 2 groups of heat exchangers

FIG. 6

Figure 5:
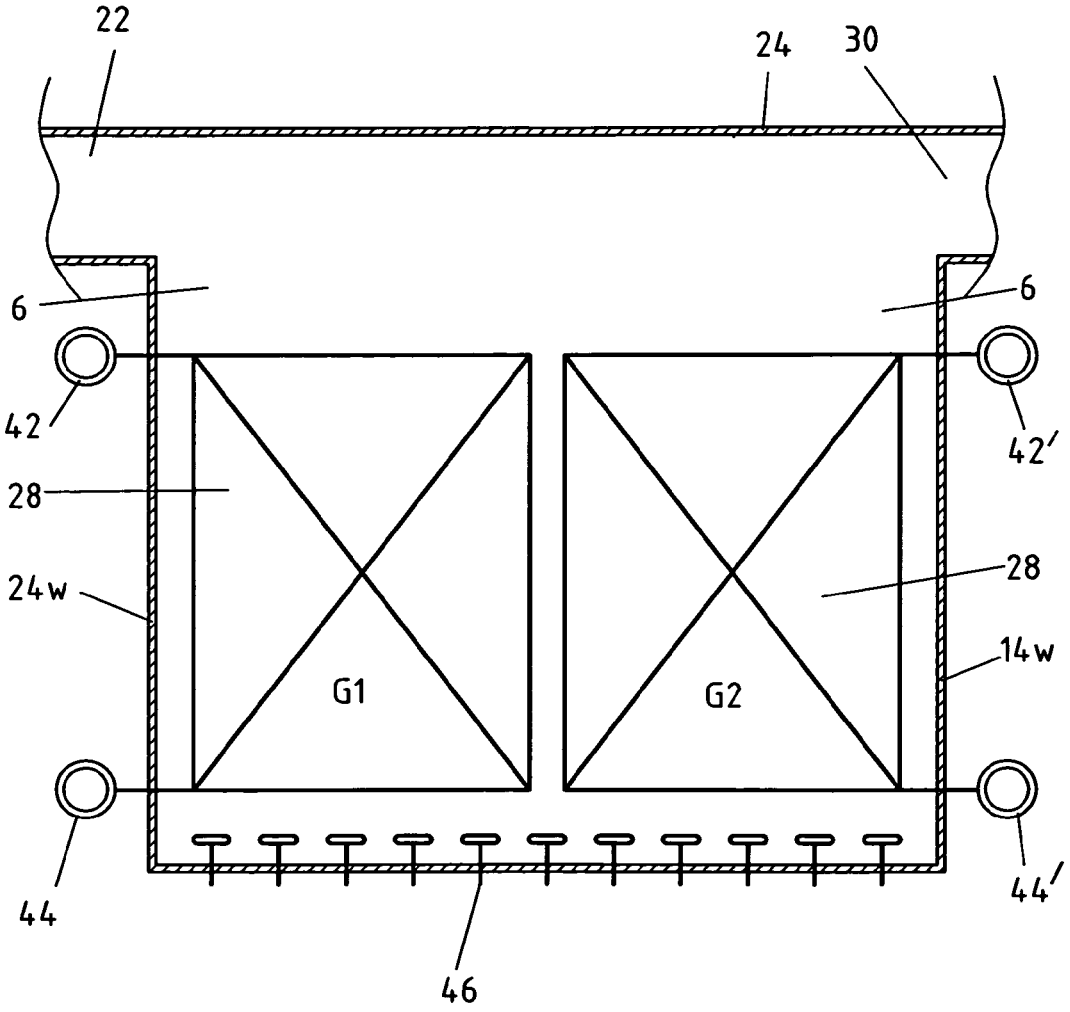

A top view on the FBHE of FIG. 5 along line 6-6

FIG. 7

A top view on a further example for a FBHE 24 with an amended inlet port

FIG. 8*a*

A cross sectional view of an FBHE with multiple nozzles sets in the bottom area

FIG. 8*b*

A cross sectional view of a syphon with multiple nozzles sets in the bottom area

FIG. 9

An general view of a fluidized bed apparatus mounted in a suspended manner

FIG. 10

A compact fluidized bed heat exchanger in a 3-dimensional view

In the Figures identical an similar acting construction parts are identified by same numerals.

FIG. 1 discloses the general concept of a fluidized bed apparatus and its main components according to the present invention.

It comprises:

A circulating fluidized bed reactor (CFBR) 10. Its lower part comprises a grate-like structure 12 through which air (arrow A1) is blown into a reactor chamber 14 via (not shown) nozzles, thus providing a fluidized bed (denseboard—DB—) above said grate 12, wherein said denseboard comprises a particulate material like coal, wood etc. to be burnt.

The CFBR has two outlet ports 16 at opposite sides of its upper part, allowing a mixture of gas and solid particles exhausted from the CFBR to flow into associated separators 18, namely cyclone separators. The separators serve to separate solid particles from the gas.

Transfer means 20, designed as ducts, extend from the lower end of each separator 18 downwardly and into an inlet port 22 along the ceiling 24*c* of a fluidized bed heat exchanger (FBHE) 24.

A syphon-like tube construction 26 (U-shaped) extends from the lower end of each separator 18 into reactor chamber 14 and enters into chamber 14 shortly above grate 12 of said CFBR.

The FBHE is equipped with (plate-like) heat transfer means 28 and an outlet port 30 merging into reactor chamber 14 at the same vertical height as tube construction 26.

This concept belongs to prior art. Insofar details are not further illustrated as known to the skilled person.

The invention includes one or more of the following features:

According to FIG. 2 the fluidized bed heat exchanger 24 displays an inlet port 22 at its upper end (in FIG. 2: top left) and an outlet port 30 at its upper end (in FIG. 2: top right), i. e. opposite to each other. Said outlet port 30 provides return means for solid particles transported along transfer duct 20 into said FBHE and is provided within a common wall 14*w* of chamber 14 and FBHE 24.

Outlet port 30 comprises multiple flow through openings, arranged in a horizontal row with a distance to each other along a corresponding wall section of said wall 14*w*.

Said wall 14*w* is water-cooled, namely constructed of vertically extending tubes with fins running between adjacent tubes. The tubes are cooled by water fed through said tubes.

The through holes having the function of discrete outlet ports are shown in FIG. 2 in a slightly inclined orientation, with a lower end towards the fluidized bed heat exchanger 24 and a higher end towards the fluidized bed reactor chamber 14.

This inclined orientation (sloped outlet port 30) can be provided as part of a 3-dimensional profile (for example as a convexity 14*w*') of said wall 14*w* towards the inner space/chamber of the fluidized bed heat exchanger 24 as shown in dotted lines in FIG. 2 and characterized by numeral 30'.

FIG. 2 further shows the design and construction of heat transfer means 28 within the fluidized bed heat exchanger 24. In the Figure only one of said heat transfer means is shown. Further heat transfer means of equal design are placed at a distance to each other within FBHE 24 (perpendicular to the plane of projection).

Steam is fed into said means 28 via a central feeding line 42, then flowing through the meandering tube (as shown), providing said means 28, and escaping via a common outlet line 44, allowing to take heat from the particulate material (symbolized by dots P) moving through FBHE 24 between inlet port 22 and outlet port 30.

It is important that each of said means 28 is designed in a wall-like pattern and extending substantially parallel to the main flow direction of the solid particles on their way to and through the outlet port 30, symbolized in FIG. 2 by arrow S.

All tubes 28 are connected to the same feeding line 42 and outlet line 44.

The meandering tubes not only give the heat transfer means 28 a wall-like pattern but as well a grid-like structure to allow the particulate material to pass through as well in a horizontal direction.

The horizontally extending sections of said tubes are about three times longer than the vertically extending sections (FIG. 2 is not drawn to scale). Adjacent horizontal sections extent to a distance to each other being about the tube diameter.

As shown in FIG. 2 the heat transfer means 28 extent about more than 60% of the chamber height, being the distance between a chamber bottom 24*b* and a chamber sealing 24*c*. In the embodiment each of said wall-like heat transfer means 28 extends from slightly above bottom 24*b* to slightly below inlet port 22 and from slightly off wall 14*w* to slightly off opposite wall 24*w*.

This allows to avoid any structural means within FBHE 24 which could otherwise urge the solid particles to meander within FBHE. In particular the new design allows to avoid any entrance chamber and/or return chamber for the particulate material to homogenize.

In prior art devices a separate entrance chamber EC with a discrete partition wall is constructed between wall 24 *w* and adjacent part of heat transfer means 28 as well as a separate return chamber RC between wall 14 *w* and parts 28. These walls and chambers caused the stream of solid particles to flow up and down, which is now avoided with the new design without any partition walls.

Figure 3:
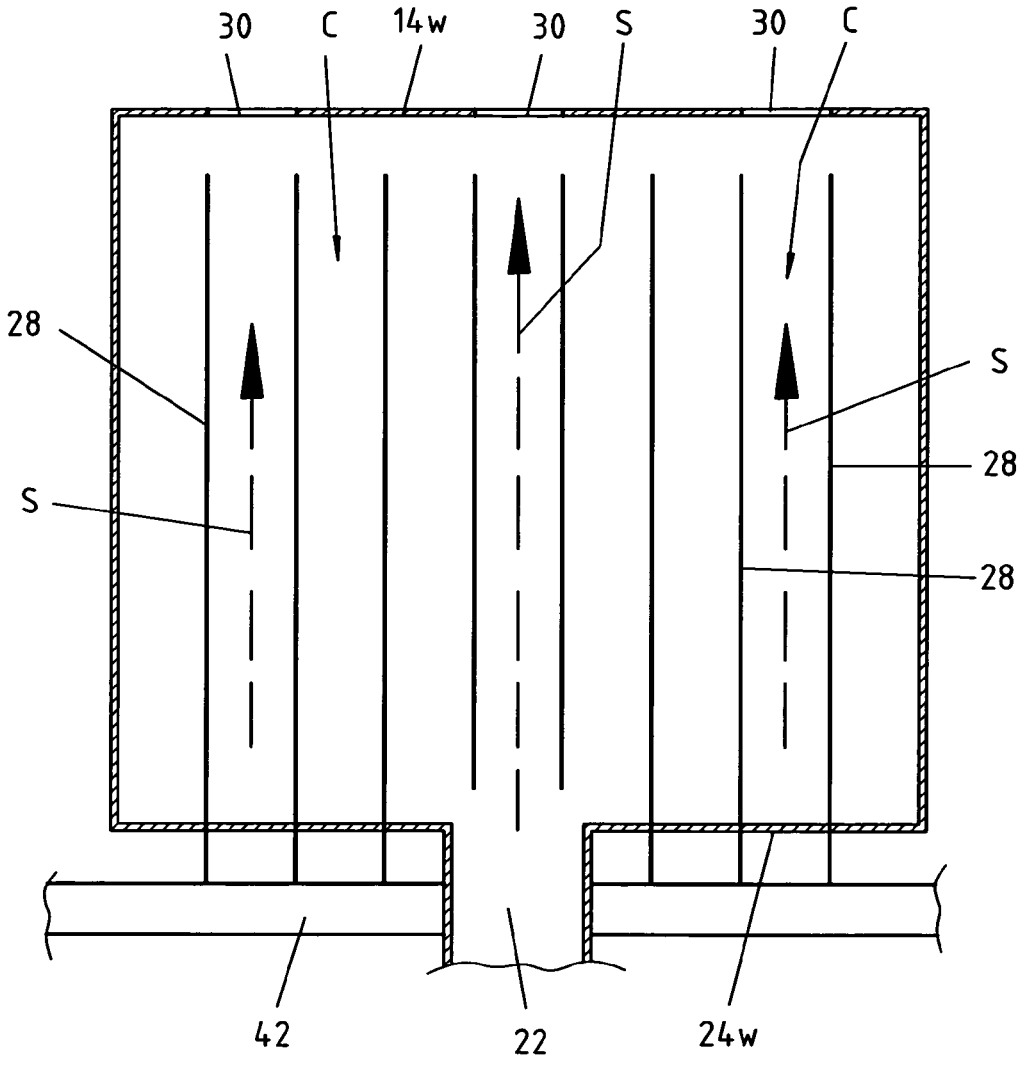

The particulate material may take a direct way from the inlet port 22 to the outlet port 30 (see arrow S) along the channels/gaps C formed between adjacent tubes (heat transfer means), as may be seen in FIG. 3.

Fluidization of the particulate material within FBHE 24 is achieved by air nozzles 46 in the bottom area 24*b*. The particulate material is circulated by said purging means within FBHE 24 in order to optimize heat transfer from the hot solid particles P onto the steam flowing within tube like heat transfer means 28.

Figure 4:
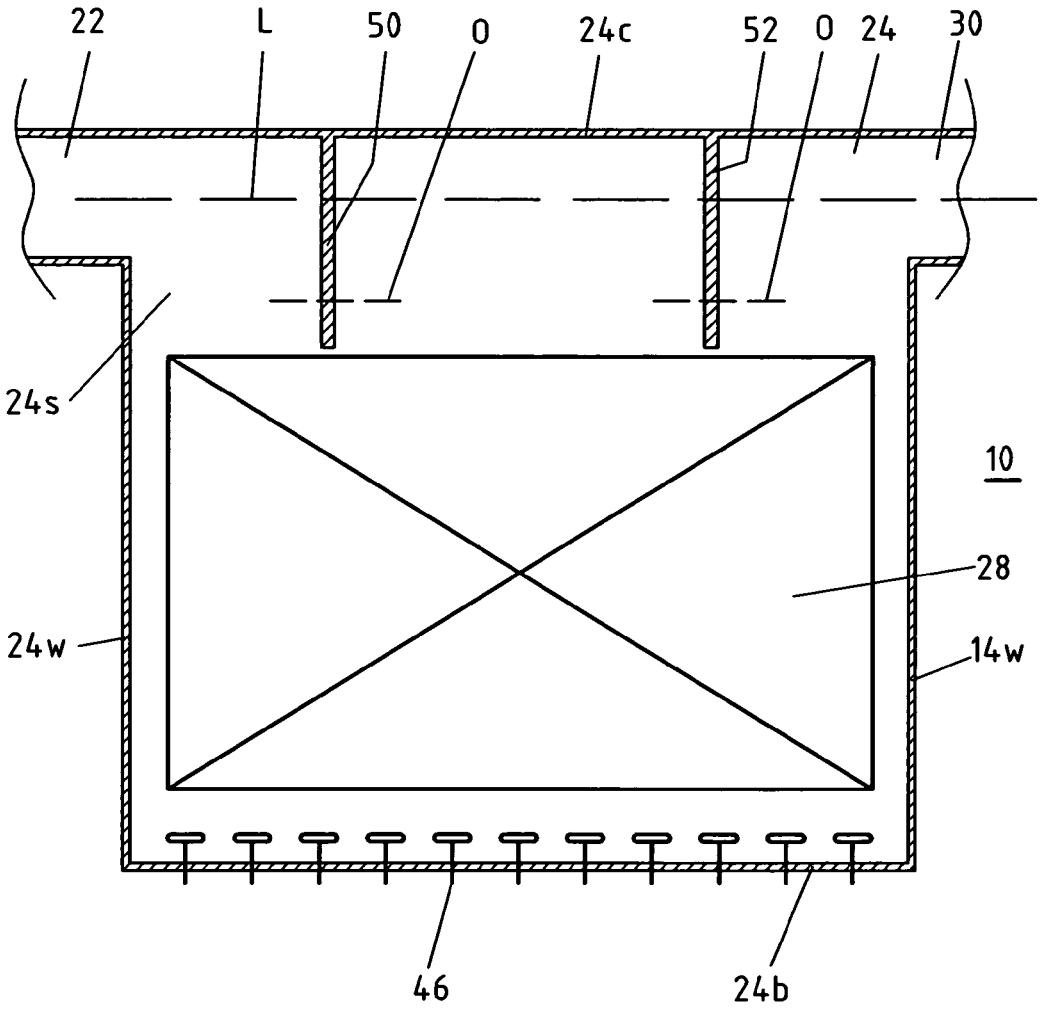

The embodiment of FIG. 4 differs from that of FIGS. 2,3 insofar as two baffles 50, 52 extent from sealing 24*c* downwardly, ending shortly above heat transfer means 28. These baffles 50, 52 extend substantially perpendicular to a straight line between inlet port 22 and outlet port 30 (dotted line L).

Both baffles 50, 52 extend between opposite walls of FBHE 24 (only one, namely 24*s* is shown), being the walls bridging said walls 14*w*, 24*w*. The baffles 50, 52 are arranged at a distance to each other.

Each of said baffles 50, 52 comprise one opening symbolized by dotted line O to allow pressure adjustment (equalization) within the inner space of FBHE 24.

The said baffle(s) 50, 52 may as well be designed like a curtain, fulfilling the same function as a continuous board, namely to urge the particulate material to flow through said channels C (FIG. 3) between adjacent heat transfer means 28 on their way between inlet port 22 and outlet port 30.

In FIG. 4 outlet port 30 is extended, namely protruding into circulating fluidized bed reactor 10.

In the embodiment according to FIG. 5 the multiplicity of heat transfer means 28 is split into two groups.

A first group G1 is made of a number of heat transfer means 28 as shown in FIGS. 2, 3 with the exception that the horizontal extension between walls 24*w*, 14*w* is much shorter and ending about half the way between said walls 14*w*, 24*w*.

This group G1 of multiple heat transfer tubes 28 connected to a common feeding line 42 and a common outlet line 44 is characterized by a feeding temperature of 480° C. and an outlet temperature of 560° C. of the heat transfer medium (steam) and an average steam pressure of 32 bar, thus fulfilling the function of a so called reheater.

The second group G2 of several heat transfer means 28 is constructed the same way as group G1 but connected so separate inlet lines 42' and outlet lines 44' for said steam and designed to achieve a heat transfer medium temperature of between 510° C. (inlet temperature) and 565° C. (outlet temperature) as well as an average 170 bar pressure. This allows to use the tubes of group G2 as a so called superheater.

As shown in FIG. 5 tubes of group G2 are arranged closer to the outlet port 30 and adjacent to wall 14*w* while tubes of group G1 are arranged adjacent to wall 24*w* with a distance between groups G1 and G2.

Figure 6:
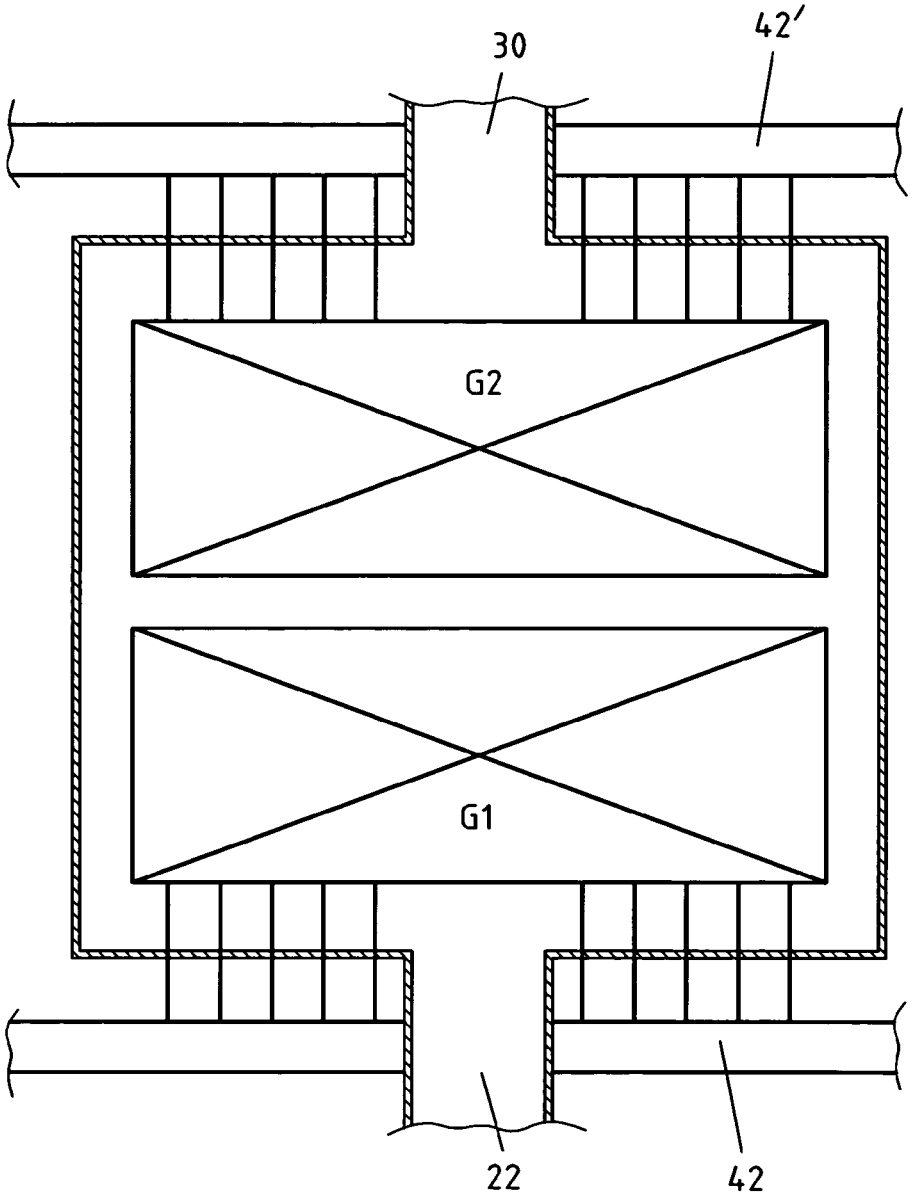

FIG. 6 is a top view of FIG. 5 along line 6-6 in FIG. 5.

Figure 7:
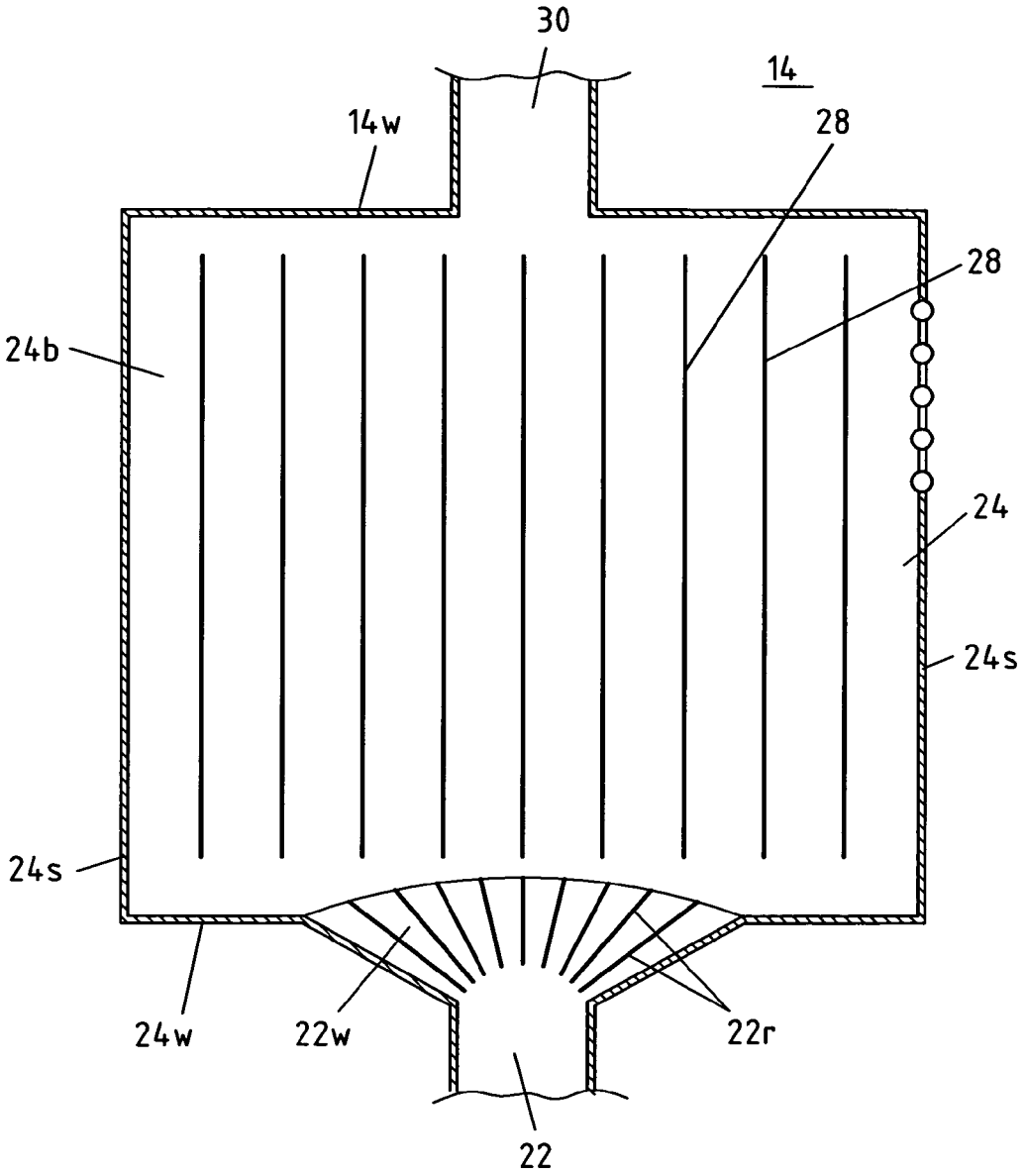

The fluidized bed heat exchanger 24 according to FIG. 7 displays a different design around inlet port 22, which widens towards the inner space of chamber 24, wherein said widened section 22*w* is further inclined towards the bottom area 24*b* of FBHE 24 to provide a distributor means allowing the entering stream of solid particles to spread over substantially the full width of said inner space of chamber 24, wherein the width is defined by the distance of side wall 24*s*.

This distributor means (section 22*s*) are arranged in a transition region defined by end section of inlet port 22 and the adjacent section of chamber 24, extending upstream of said heat transfer means 28 and extending over about ⅔ of the chamber width.

Ribs 22*r* protrude from the surface of said distributor 22*s* and are arranged in a star-like pattern.

Again all walls 14*w*, 24*w* and 24*s* of said FBHE are made of water-cooled tubes with fins between adjacent tubes, symbolized in the right part of FIG. 7.

Figure 8A:
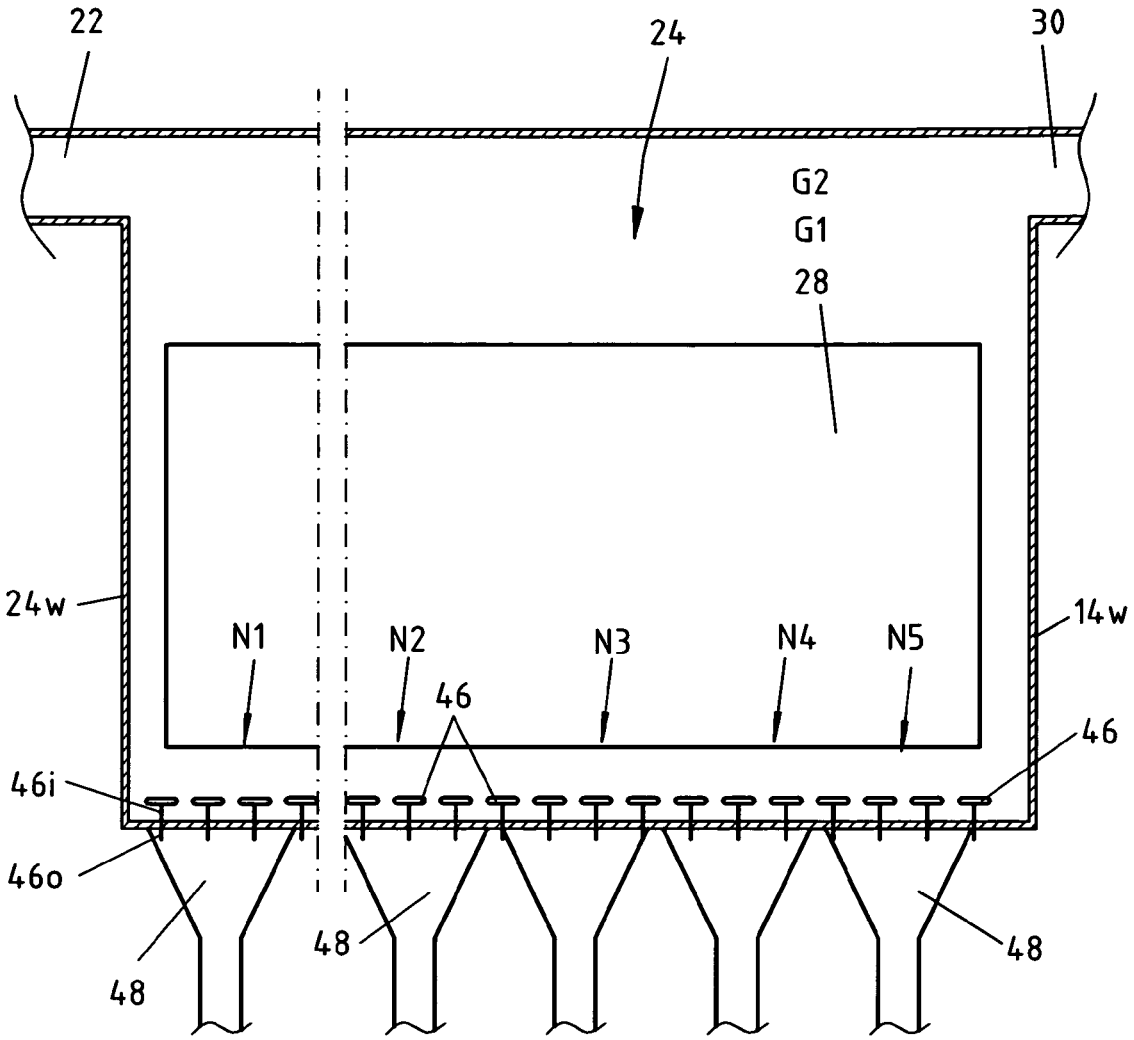

FIG. 8*a* displays an FBHE 24 characterized by a modified bottom area 24*b*.

Numerous air nozzles 46 are mounted within bottom 24*b*. Each nozzle comprises an outer end 46*o*, protruding downwardly from the outer surface of bottom 24*b* and an inner end 46*i*, protruding into the hollow space of FHBE 24 equipped with groups G1, G2 of heat exchange tubes 28.

The nozzles 46 are assembled into five nozzle sets N1, N2, N3, N4 and N5, one behind the other in a row between walls 24*w* and 14*w*. All nozzles 46 of a nozzle set are commonly connected to a respective common gas channel 48. If air is fed along one of these channels all corresponding nozzles 46 will be activated to allow air to enter into FBHE 24.

The arrangements of discrete nozzle sets N1 . . . N5 with discrete channels 48 make it possible to set different air pressure in different channels and accordingly to introduce air into the fluidized bed of solid particles within FBHE under different pressure at different areas to optimize homogenisation of the particles within the fluidized bed.

Figure 8B:
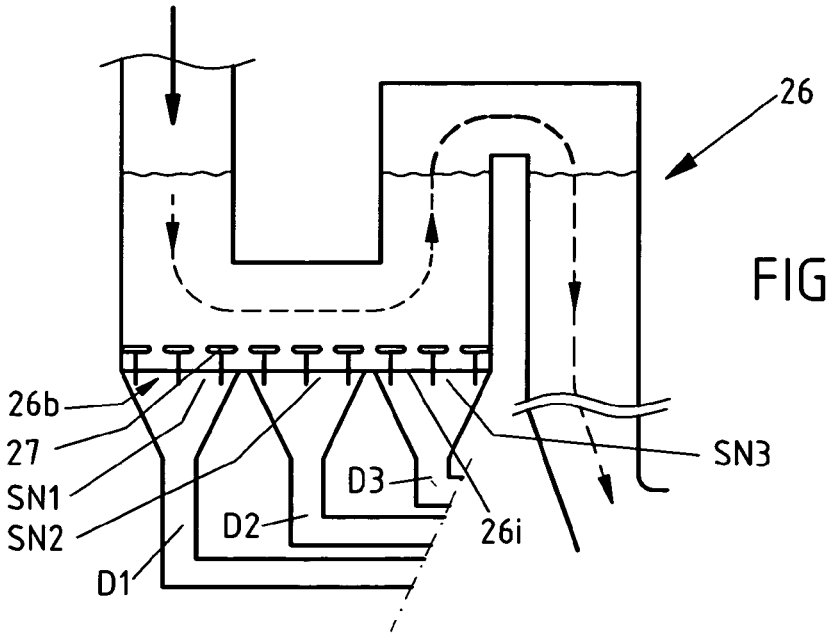

A similar design may be used to improve the syphon-type seal 26 between separator 18 and FBHE 24 or reactor 10 respectively, as illustrated in FIG. 8*b*.

A mixture of gas and solid particles like ash coming from separator 18

- enters the inlet tube of the U-shaped syphon 26 in a downward direction,
- is then fluidized by a fluidized bed construction in a bottom area 26*b* of said inlet tube via nozzles 27,
- turns about 90 degrees,
- flows along an intermediate chamber section 26*i*, where further fluidization takes place,
- then turns up into an outlet tube of the U-shaped syphon 26, where further fluidization by nozzles 27 at the bottom area of said outlet tube may take place, before
- flowing along another U-shaped tube section and entering the CFBR 10 via a corresponding return line.

Similar to the embodiment of FIG. 8*a*, the multiplicity of air nozzles 27 is split into three nozzles sets SN1, SN2 and SN3, each with a certain number of nozzles 27, and each coupled to a respective air duct D1, D2 and D3, feeding air to the respective nozzles 27 under same or different pressure.

Similar to FIG. 8*a* the air ducts D1 . . . D3 have a funnel shape at their upper ends.

Figure 9:
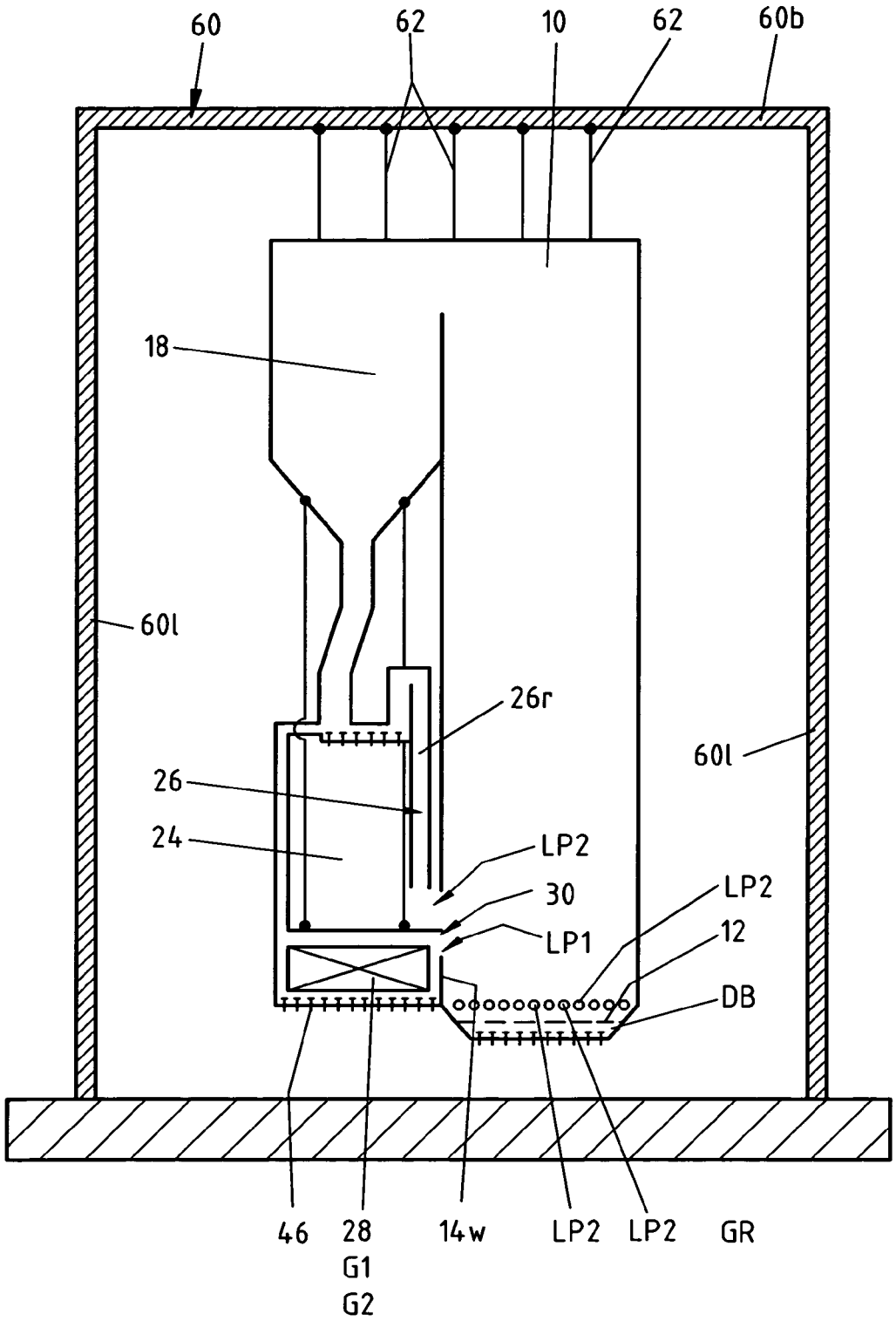

FIG. 9 represents a fluidized bed apparatus wherein its main components, namely the CFBR 10, the FBHE 24 as well as corresponding separators 18 are mounted in a suspended manner to a central supporting structure, namely a frame 60. The frame 60 has the shape of an inverted U with its legs 60*l* fixed within ground GR.

While the CFBR 10 and the separator 18 are each directly suspended from base 60*b* of frame structure 60 (by posts 62), the FBHE 24 is mounted in a suspended manner from separator 18.

Mechanical stability of FBHE 24 is further achieved by said common, water-cooled wall 14*w* with CFBR 10.

Because of the hanging structure thermal expansion and constriction take place at all components in the same direction and avoids mechanical as well as thermo-mechanical tensions between adjacent construction parts at most.

To make the construction wear resistant, the fluidized bed heat exchanger has no refractory lining; all walls are water cooled metal walls.

The hanging structure allows an integration of a syphon 26 with its return duct 26*r* without transferring mechanical forces or moments between the respective construction parts.

According to FIG. 9 the lowermost point LP1 of outlet port 30 of fluidized bed heat exchanger 24 enters the circulating fluidized bed reactor 10 at a height of >0.15 L, calculated from the lowermost end of the axial length L of CFBR 10. The lowermost end is defined by grate 12 of the fluidized bed. The minimum distance of >0.1 L, better >0.2 L, allows to place the return means 30 out of the so called denseboard DB and avoids the risk of any backflow of solid particles from the fluidized bed within reactor 10 into the associated construction elements like FBHE 24. This feature may be combined with sloped outlet ports 30 as disclosed in FIG. 2 or sloped return ducts 26*r*.

The lowermost point of return duct 26*r* of syphon 26 enters the CFBR at a height of the denseboard DB, close to grate 12 and below outlet port 30.

This positioning of the two outlet ports/return means 30,26*r* to each other is an important combined feature valid for various applications.

Figure 10:
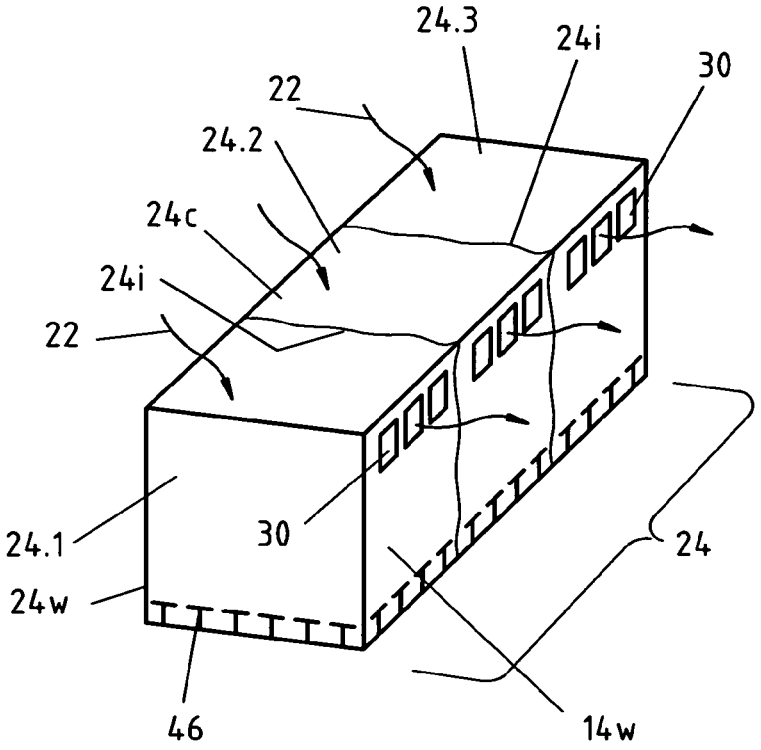

In case of an apparatus comprising more than one separator 18, for example 3 separators, FIG. 10 discloses an embodiment with three corresponding fluidized bed heat exchangers 24.1, 24.2, 24.3 which are mechanically connected to provide one common fluidized bed heat exchanger 24 of corresponding, suitable size, with water-cooled intermediate walls 24*i*. Again: all three wall sections 14*w* of the common heat exchanger 24 are part of the reactor wall 14, i.e. a common water-cooled wall with integrated outlet openings 30.

Walls 14*i*, 14*w* are made of metal tubes, welded to each other and connected with a fluid source to feed cooling water through said tubes.

The invention claimed is:

1. An apparatus comprising:

a fluidized bed, wherein the fluidized bed includes
- a circulating fluidized bed reactor (10) with at least one outlet port (16) at its upper part, wherein said outlet port (16) allows a mixture of gas and solid particles exhausted from the circulating fluidized bed reactor (10) to flow into at least one associated separator (18) for separating solid particles from said gas, means (20) to transfer said separated solid particles into at least one fluidized bed heat exchanger, and return means to transport at least part of said solid particles back into the circulating fluidized bed reactor (10), wherein
- a) the fluidized bed reactor (10) and the fluidized bed heat exchanger (24) have one common wall (14*w*),
- b) the fluidized bed heat exchanger comprises
  - b1) only one single chamber (24), wherein the only one single chamber (24) includes an interior area, wherein the interior area is enclosed and separated from the circulating fluidized bed reactor (10) such that no particles move from the reactor (10) to the chamber (24) without first moving through the separator (18),
  - b2) at least one solid particles inlet port (22) arranged on the only one single chamber,
  - b3) at least one solid particles outlet port (30) arranged on the only one single chamber at a distance and opposite to the at least one inlet port (22),
  - b4) means (46) for introducing a fluidizing gas into a bottom area (24*b*) of said only one single chamber (24),
  - b5) at least two distinct sets of heat transfer means (28, G1, G2) within said only one single chamber (24),
    - b5i) each of said two heat transfer means (28, G1, G2) being provided with a respective heat transfer medium inlet port (42) and a respective heat transfer medium outlet port (44), wherein
    - b5ii) the at least two heat transfer means (28, G1, G2) being arranged relative to the other in the only one single chamber allowing all solid particles to take a direct way through the at least two heat transfer means (28, G1, G2) from the at least one inlet port (22) to the at least one outlet port (30), wherein the at least two heat transfer means include
    - b5iii) a first heat transfer means (28) that is designed as a reheater and a second heat transfer means (28) that is designed as a superheater to achieve a heat transfer medium temperature and a heat transfer medium pressure above that of the reheater.

2. An apparatus comprising:

a circulating fluidized bed reactor,
- wherein the circulating fluidized bed reactor includes a fluidized bed,
  - wherein the fluidized bed is operative to produce a mixture of hot gas and hot solid particles,
- wherein the circulating fluidized bed reactor includes a reactor chamber that houses the fluidized bed,
  - wherein the reactor chamber includes an upper part,
    - wherein the upper part of the reactor chamber includes a reactor outlet port,
      - wherein the reactor outlet port is operative to pass all of the mixture of gas and solid particles produced by the circulating fluidized bed reactor from the reactor chamber, a cyclone separator,
- wherein the cyclone separator is in operative connection with the reactor outlet port,
- wherein the cyclone separator is operative to receive from the reactor chamber all of the mixture of gas and solid particles produced by the circulating fluidized bed reactor,
- wherein the cyclone separator is operative to separate the solid particles from the gas,
- wherein the cyclone separator includes a gas outlet from which the gas is exhausted from the cyclone separator and a particle outlet from which the particles leave the separator, a first conduit,
- wherein the first conduit is in operative connection with the particle outlet of the cyclone separator, a fluidized bed heat exchanger,
- wherein the fluidized bed heat exchanger includes only one single heat exchanger chamber,
- wherein the only one single fluidized bed heat exchanger chamber is in operative connection with the particle outlet of the cyclone separator through the first conduit,
- wherein the first conduit is operative to transfer a first portion constituting less than all of the separated solid particles from the cyclone separator into the only one single heat exchanger chamber wherein the solid particles are in operative contact with the fluidized bed heat exchanger, a second conduit, wherein the second conduit is in operative connection with the particle outlet of the cyclone separator, wherein the second conduit is operative to transport a second portion constituting a remainder of the separated solid particles from the cyclone separator not included in the first portion, into the reactor chamber, a support frame, wherein the support frame includes a horizontally extending upper base, wherein the upper base of the support frame includes a plurality of posts, wherein the posts extend downward from the upper base, wherein the circulating fluidized bed reactor and the cyclone separator are mounted in a horizontally disposed side-by-side vertically suspended manner from the plurality of posts, whereby the suspended mounting of the circulating fluidized bed reactor prevents damage due to expansion and constriction, wherein the fluidized bed heat exchanger and the fluidized bed are arranged in horizontally disposed side-by-side relation and are separated only by a single vertically extending common wall, wherein the single common wall includes a heat exchanger outlet port, wherein the heat exchanger outlet port is operative to pass solid particles from the only one single fluidized bed heat exchanger chamber to the reactor chamber.

3. The apparatus according to claim 2, wherein the reheater is constructed to allow a heat transfer medium temperature of up to 600° C.

4. The apparatus according to claim 2, wherein the reheater is constructed to allow a heat transfer medium pressure of up to 50 bar.

5. The apparatus according to claim 2, wherein the superheater is constructed to allow a heat transfer medium temperature of up to 600° C.

6. The apparatus according to claim 2, wherein the superheater is constructed to allow a heat transfer medium pressure of up to 190 bar.

7. The apparatus according to claim 2, wherein at least one of said reheater or superheater is made of a multiplicity of heat transfer tubes for conveying a heat transfer medium and arranged in a meandering fashion.

8. The apparatus according to claim 2, wherein the only one single chamber includes chamber walls, the chamber walls being at least partially water-cooled.

9. The apparatus according to claim 2, wherein the common wall (14*w*) is water-cooled.

10. The apparatus according to claim 2, and further comprising a syphon, wherein the syphon is in fluid connection with the particle outlet.

11. The apparatus according to claim 2, and further comprising a further fluidized bed, wherein the second conduit includes the further fluidized bed, wherein the further fluidized bed is comprised of a plurality of horizontally disposed nozzles on a bottom wall of the second conduit.

12. The apparatus according to claim 11, wherein the only one single heat exchanger chamber of the fluidized bed heat exchanger further includes a heat exchanger inlet port, wherein the heat exchanger inlet port is in operative connection with the first conduit, and at least one heat transfer tube.

13. The apparatus according to claim 12, wherein the solid particles transferred from the cyclone separator through the first conduit enter the only one single heat exchanger chamber through the heat exchanger inlet port, wherein the solid particles move through the only one single heat exchanger chamber in a direct path from the heat exchanger inlet port to the heat exchanger outlet port, wherein the heat exchanger outlet port is disposed directly horizontally of the heat exchanger inlet port and at a common vertical elevation with the heat exchanger inlet port, and wherein no vertically extending partition walls extend intermediate of the heat exchanger inlet port and the heat exchanger outlet port.

14. The apparatus according to claim 13, wherein the cyclone separator is in operative connection with a plurality of vertically extending separator posts, wherein the fluidized bed heat exchanger is vertically suspended from the cyclone separator by operative connection with the plurality of separator posts.

15. The apparatus according to claim 14, and further including a fluid source, wherein the single common wall includes a plurality of cooling tubes, wherein the plurality of cooling tubes are in operative connection with the fluid source and are operative to cool the single common wall.

16. The apparatus according to claim 15, wherein the cyclone separator includes at least two cyclone separators each in operative connection with the reactor chamber through respective reactor outlet ports, wherein each of the at least two cyclone separators include a respective gas outlet, and particle outlet, and further including at least two fluidized bed heat exchangers, wherein each of the at least two fluidized bed heat exchangers are in operative connection with a respective particle outlet of a respective cyclone separator and through a respective first conduit, wherein each of the at least two fluidized bed heat exchangers include a respective heat exchanger chamber, heat exchanger inlet port, at least one heat transfer tube, and heat exchanger outlet port.

17. The apparatus according to claim 16, wherein each of the at least two fluidized bed heat exchangers are arranged in operatively connected side-by-side relation and each fluidized bed heat exchanger is separated from each immediately adjacent fluidized bed heat exchanger by an intermediate water-cooled wall, and wherein each of the at least two fluidized bed heat exchangers are separated from the reactor chamber only by a respective single vertically extending common wall.

18. The apparatus according to claim 2, wherein the only one single heat exchanger chamber further includes a heat exchanger chamber fluidized bed, wherein the heat exchanger chamber fluidized bed is comprised of a plurality of horizontally disposed chamber nozzles on a bottom wall of the heat exchanger chamber.

19. The apparatus according to claim 18 further comprising:

a conduit fluidized bed, wherein the conduit fluidized bed is comprised of a plurality of horizontally disposed conduit nozzles, wherein the plurality of conduit nozzles are in operative connection with at least one of the first conduit intermediate of the cyclone separator and the fluidized bed heat exchanger, and the second conduit intermediate of the cyclone separator and the circulating fluidized bed reactor chamber.

20. An apparatus comprising:

a circulating fluidized bed reactor, wherein the circulating fluidized bed reactor includes a fluidized bed, wherein the fluidized bed is operative to produce a mixture of hot gas and hot solid particles, wherein the circulating fluidized bed reactor includes a reactor chamber that houses the fluidized bed, wherein the reactor chamber includes an upper part, wherein the upper part of the reactor chamber includes a reactor outlet port, wherein the reactor outlet port is operative to pass all of the mixture of gas and solid particles produced by the circulating fluidized bed reactor from the reactor chamber, a cyclone separator, wherein the cyclone separator is in operative connection with the reactor outlet port, wherein the cyclone separator is operative to receive from the reactor chamber all of the mixture of gas and solid particles produced by the circulating fluidized bed reactor, wherein the cyclone separator is operative to separate the solid particles from the gas, wherein the cyclone separator includes a gas outlet from which the gas is exhausted from the cyclone separator and a particle outlet from which the particles leave the separator, a first conduit, wherein the first conduit is in operative connection with the particle outlet of the cyclone separator, a fluidized bed heat exchanger, wherein the fluidized bed heat exchanger includes only one single heat exchanger chamber, wherein the only one single fluidized bed heat exchanger chamber is in operative connection with the particle outlet of the cyclone separator through the first conduit, wherein the first conduit is operative to transfer a first portion constituting less than all of the separated solid particles from the cyclone separator into the only one single heat exchanger chamber wherein the solid particles are in operative contact with the fluidized bed heat exchanger, wherein, before any of the solid particles produced by the circulating fluidized bed reactor are transferred into the only one single chamber of the fluidized bed heat exchanger, the solid particles that are transferred into the one single chamber are first transferred from the reactor chamber to the cyclone separator through the reactor outlet port, a second conduit, wherein the second conduit is in operative connection with the particle outlet of the cyclone separator, wherein the second conduit is operative to transport a second portion constituting a remainder of the separated solid particles from the cyclone separator not included in the first portion, into the reactor chamber, wherein the fluidized bed heat exchanger and the fluidized bed are arranged in horizontally disposed side-by-side relation and are separated only by a single vertically extending common wall, wherein the single common wall includes a heat exchanger outlet port, wherein the heat exchanger outlet port is operative to pass solid particles from the fluidized bed heat exchanger chamber to the reactor chamber.

21. An apparatus comprising:

a circulating fluidized bed reactor, wherein the circulating fluidized bed reactor includes a fluidized bed, wherein the fluidized bed is operative to produce a mixture of hot gas and hot solid particles, wherein the circulating fluidized bed reactor includes a reactor chamber that houses the fluidized bed, wherein the reactor chamber includes an upper part, wherein the upper part of the reactor chamber includes a reactor outlet port, wherein the reactor outlet port is operative to pass all of the mixture of gas and solid particles produced by the circulating fluidized bed reactor from the reactor chamber, a cyclone separator, wherein the cyclone separator is in operative connection with the reactor outlet port, wherein the cyclone separator is operative to receive from the reactor chamber all of the mixture of gas and solid particles produced by the circulating fluidized bed reactor, wherein the cyclone separator is operative to separate the solid particles from the gas, wherein the cyclone separator includes a gas outlet in which the gas is exhausted from the cyclone separator and a particle outlet from which the particles leave the separator, a first conduit, wherein the first conduit is in operative connection with the particle outlet of the cyclone separator, a fluidized bed heat exchanger, wherein the fluidized bed heat exchanger includes only one single heat exchanger chamber, wherein the only one single fluidized bed heat exchanger chamber is in operative connection with the particle outlet of the cyclone separator through the first conduit, wherein the first conduit is operative to transfer a first portion constituting less than all of the separated solid particles from the cyclone separator into the only one single heat exchanger chamber wherein the solid particles are in operative contact with the fluidized bed heat exchanger, wherein the only one single heat exchanger chamber includes at least two distinct heat transfer means within the only one single heat exchanger chamber, wherein one of the at least two distinct heat transfer means comprises a reheater and the other of the at least two distinct heat transfer means comprises a superheater, wherein the superheater is operative to achieve a heat transfer medium temperature and a heat transfer medium pressure above the reheater, a second conduit, wherein the second conduit is in operative connection with the particle outlet of the cyclone separator, wherein the second conduit is operative to transport a second portion constituting a remainder of the separated solid particles from the cyclone separator not included in the first portion, into the reactor chamber, a support frame, wherein the support frame includes a horizontally extending upper base, wherein the upper base of the support frame includes a plurality of posts, wherein the posts extend downward from the upper base, wherein the circulating fluidized bed reactor and the cyclone separator are mounted in a horizontally disposed side-by-side vertically suspended manner from the plurality of posts, whereby the suspended mounting of the circulating fluidized bed reactor prevents damage due to expansion and constriction, wherein the fluidized bed heat exchanger and the fluidized bed are arranged in horizontally disposed side-by-side relation and are separated only by a single vertically extending common wall, wherein the single common wall includes a heat exchanger outlet port, wherein the heat exchanger outlet port is operative to pass solid particles from the only one single fluidized bed heat exchanger chamber to the reactor chamber.

22. The apparatus according to claim 21, wherein the only one single heat exchanger chamber of the fluidized bed heat exchanger includes at least one solid particles inlet port and at least one solid particles outlet port, wherein the at least one solid particles outlet port is arranged on the only one single heat exchanger chamber at a distance from and opposite to the at least one inlet port.

23. The apparatus according to claim 22, wherein the reheater and the superheater are arranged relative to each other to allow all solid particles to take a direct way through the reheater and the superheater from the at least one solid particles inlet port to the at least one solid particles outlet port.

24. An apparatus comprising:

a circulating fluidized bed reactor, wherein the circulating fluidized bed reactor includes a fluidized bed, wherein the fluidized bed is operative to produce a mixture of hot gas and hot solid particles, wherein the circulating fluidized bed reactor includes a reactor chamber that houses the fluidized bed, wherein the reactor chamber includes an upper part, wherein the upper part of the reactor chamber includes a reactor outlet port, wherein the reactor outlet port is operative to pass all of the mixture of gas and solid particles produced by the circulating fluidized bed reactor from the reactor chamber, a cyclone separator, wherein the cyclone separator is in operative connection with the reactor outlet port, wherein the cyclone separator is operative to receive from the reactor chamber all of the mixture of gas and solid particles produced by the circulating fluidized bed reactor, wherein the cyclone separator is operative to separate the solid particles from the gas, wherein the cyclone separator includes a gas outlet in which the gas is exhausted from the cyclone separator and a particle outlet from which the particles leave the separator, a first conduit, wherein the first conduit is in operative connection with the particle outlet of the cyclone separator, a fluidized bed heat exchanger, wherein the fluidized bed heat exchanger includes only one single heat exchanger chamber, wherein the only one single fluidized bed heat exchanger chamber is in operative connection with the particle outlet of the cyclone separator through the first conduit, wherein the first conduit is operative to transfer a first portion constituting less than all of the separated solid particles from the cyclone separator into the only one single heat exchanger chamber wherein the solid particles are in operative contact with the fluidized bed heat exchanger, wherein before any of the solid particles produced by the circulating fluidized bed reactor are transferred into the only one single chamber of the fluidized bed heat exchanger, the solid particles that are transferred into the one single chamber are first transferred from the reactor chamber to the cyclone separator through the reactor outlet port, wherein the only one single heat exchanger chamber includes at least two distinct heat transfer means within the only one single heat exchanger chamber, wherein one of the at least two distinct heat transfer means comprises a reheater and the other of the heat transfer means comprises a superheater, wherein the superheater is operative to achieve a heat transfer medium temperature and a heat transfer medium pressure above the reheater, a solid particles inlet port and a solid particles outlet port, wherein the solid particles outlet port is arranged on the only one single heat exchanger chamber at a distance from and opposite to the inlet port, wherein the reheater and the superheater are arranged relative to each other in the only one single chamber to allow all solid particles to take a direct way through the reheater and the superheater from the solid particles inlet port to the solid particles outlet port, a second conduit, wherein the second conduit is in operative connection with the particle outlet of the cyclone separator, wherein the second conduit is operative to transport a second portion constituting a remainder of the separated solid particles from the cyclone separator not included in the first portion, into the reactor chamber, wherein the fluidized bed heat exchanger and the fluidized bed are arranged in horizontally disposed side-by-side relation and are separated only by a single vertically extending common wall, wherein the single wall is in direct connection with the heat exchanger outlet port, wherein the heat exchanger outlet port is operative to pass solid particles from the fluidized bed heat exchanger chamber to the reactor chamber.

25. Apparatus comprising:

a circulating fluidized bed reactor, wherein the circulating fluidized bed reactor includes a fluidized bed, wherein the fluidized bed is operative to produce a mixture of hot gas and hot solid particles, wherein the circulating fluidized bed reactor includes a reactor chamber that houses the fluidized bed, wherein the reactor chamber includes an upper part, wherein the upper part of the reactor chamber includes a reactor outlet port, wherein the reactor outlet port is operative to pass all of the mixture of gas and solid particles produced by the circulating fluidized bed reactor from the reactor chamber, a cyclone separator, wherein the cyclone separator is in operative connection with the reactor outlet port, wherein the cyclone separator is operative to receive from the reactor chamber all of the mixture of gas and solid particles produced by the circulating fluidized bed reactor, wherein the cyclone separator is operative to separate the solid particles from the gas, wherein the cyclone separator includes a gas outlet in which the gas is exhausted from the cyclone separator and a particle outlet from which the particles leave the separator, a first conduit, wherein the first conduit is in operative connection with the particle outlet of the cyclone separator, a fluidized bed heat exchanger, wherein the fluidized bed heat exchanger includes only one single heat exchanger chamber, wherein the only one single fluidized bed heat exchanger chamber is in operative connection with the particle outlet of the cyclone separator through the first conduit, wherein the first conduit is operative to transfer a first portion constituting less than all of the separated solid particles from the cyclone separator into the only one single heat exchanger chamber wherein the solid particles are in operative contact with the fluidized bed heat exchanger, wherein the only one single heat exchanger chamber includes at least two distinct heat transfer means within the only one single heat exchanger chamber, wherein one of the at least two distinct heat transfer means comprises a reheater and the other of the heat transfer means comprises a superheater, wherein the superheater is operative to achieve a heat transfer medium temperature and a heat transfer medium pressure above the reheater, a solid particles inlet port and a solid particles outlet port, wherein the solid particles outlet port is arranged on the only one single heat exchanger chamber at a distance from and opposite to the inlet port, wherein the reheater and the superheater are arranged relative to each other in the only one single chamber to allow all solid particles to take a direct way through the reheater and the superheater from the solid particles inlet port to the solid particles outlet port, a second conduit, wherein the second conduit is in operative connection with the particle outlet of the cyclone separator, wherein the second conduit is operative to transport a second portion constituting a remainder of the separated solid particles from the cyclone separator not included in the first portion, into the reactor chamber, wherein any solid particles produced in the fluidized bed are caused to move from the reactor chamber to the cyclone separator and the solid particles are further caused to move from the cyclone separator to at least one of the fluidized bed heat exchanger and the reactor chamber, wherein any solid particles that enter into the fluidized bed heat exchanger must first pass through the cyclone separator, wherein the fluidized bed heat exchanger and the fluidized bed are arranged in horizontally disposed side-by-side relation and are separated only by a single vertically extending common wall, wherein the single wall is in direct connection with the heat exchanger outlet port, wherein the heat exchanger outlet port is operative to pass solid particles from the fluidized bed heat exchanger chamber to the reactor chamber.

26. Apparatus comprising:

a circulating fluidized bed reactor, wherein the circulating fluidized bed reactor includes a fluidized bed, wherein the fluidized bed is operative to produce a mixture of hot gas and hot solid particles, wherein the circulating fluidized bed reactor includes a reactor chamber that houses the fluidized bed, wherein the reactor chamber includes an upper part, wherein the upper part of the reactor chamber includes a reactor outlet port, wherein the reactor outlet port is operative to pass all of the mixture of gas and solid particles produced by the circulating fluidized bed reactor from the reactor chamber, a cyclone separator, wherein the cyclone separator is in operative connection with the reactor outlet port, wherein the cyclone separator is operative to receive from the reactor chamber all of the mixture of gas and solid particles produced by the circulating fluidized bed reactor, wherein the cyclone separator is operative to separate the solid particles from the gas, wherein the cyclone separator includes a gas outlet in which the gas is exhausted from the cyclone separator and a particle outlet from which the particles leave the separator, a first conduit, wherein the first conduit is in operative connection with the particle outlet of the cyclone separator, a fluidized bed heat exchanger, wherein the fluidized bed heat exchanger includes only one single heat exchanger chamber, wherein the only one single fluidized bed heat exchanger chamber is in operative connection with the particle outlet of the cyclone separator through the first conduit, wherein the first conduit is operative to transfer a first portion constituting less than all of the separated solid particles from the cyclone separator into the only one single heat exchanger chamber wherein the solid particles are in operative contact with the fluidized bed heat exchanger, wherein any solid particles produced in the fluidized bed are caused to move from the reactor chamber to the cyclone separator and the solid particles are further caused to move from the cyclone separator to at least one of the fluidized bed heat exchanger and the reactor chamber, wherein any solid particles that enter into the fluidized bed heat exchanger must first pass through the cyclone separator, wherein the only one single heat exchanger chamber includes at least two distinct heat transfer means within the only one single heat exchanger chamber, wherein one of the at least two distinct heat transfer means comprises a reheater and the other of the heat transfer means comprises a superheater, wherein the superheater is operative to achieve a heat transfer medium temperature and a heat transfer medium pressure above the reheater, a solid particles inlet port and a solid particles outlet port, wherein the solid particles outlet port is arranged on the only one single heat exchanger chamber at a distance from and opposite to the inlet port, wherein the reheater and the superheater are arranged relative to each other in the only one single chamber to allow all solid particles to take a direct way through the reheater and the superheater from the solid particles inlet port to the solid particles outlet port, wherein the only one single heat exchanger chamber further includes a heat exchanger chamber fluidized bed, wherein the heat exchanger chamber fluidized bed is comprised of a plurality of horizontally disposed chamber nozzles on a bottom wall of the heat exchanger chamber, a second conduit, wherein the second conduit is in operative connection with the particle outlet of the cyclone separator, wherein the second conduit is operative to transport a second portion constituting a remainder of the separated solid particles from the cyclone separator not included in the first portion into the reactor chamber, a conduit fluidized bed, wherein the conduit fluidized bed is comprised of a plurality of horizontally disposed conduit nozzles, wherein the plurality of conduit nozzles are in operative connection with at least one of the first conduit intermediate of the cyclone separator and the fluidized bed heat exchanger, and the second conduit intermediate of the cyclone separator and the circulating fluidized bed reactor chamber, wherein the fluidized bed heat exchanger and the fluidized bed are arranged in horizontally disposed side-by-side relation and are separated only by a single vertically extending common wall, wherein the single wall is in direct connection with the heat exchanger outlet port, wherein the heat exchanger outlet port is operative to pass solid particles from the fluidized bed heat exchanger chamber to the reactor chamber.

* * * * *